US011454096B2

(12) United States Patent
Bogardus et al.

(10) Patent No.: US 11,454,096 B2
(45) Date of Patent: Sep. 27, 2022

(54) TUBULAR EXPANDER WITH DETACHABLE EXPANSION RING

(71) Applicant: TIW Corporation, Houston, TX (US)

(72) Inventors: Peter T. Bogardus, Houston, TX (US); Carmine Righter, Missouri City, TX (US)

(73) Assignee: TIW Corporation, Houston, TX (US)

( * ) Notice: Subject to any disclaimer, the term of this patent is extended or adjusted under 35 U.S.C. 154(b) by 26 days.

(21) Appl. No.: 17/050,301

(22) PCT Filed: Apr. 25, 2019

(86) PCT No.: PCT/US2019/029052
§ 371 (c)(1),
(2) Date: Oct. 23, 2020

(87) PCT Pub. No.: WO2019/210023
PCT Pub. Date: Oct. 31, 2019

(65) Prior Publication Data

US 2021/0230982 A1 Jul. 29, 2021

Related U.S. Application Data

(60) Provisional application No. 62/663,564, filed on Apr. 27, 2018.

(51) Int. Cl.
*E21B 43/10* (2006.01)

(52) U.S. Cl.
CPC ..... *E21B 43/105* (2013.01)

(58) Field of Classification Search
CPC ..... E21B 43/105
See application file for complete search history.

(56) References Cited

U.S. PATENT DOCUMENTS

| | | | | |
|---|---|---|---|---|
| 8,251,137 | B2 | 8/2012 | Whiddon et al. | |
| 9,085,968 | B2 | 7/2015 | Xu et al. | |
| 2004/0173361 | A1* | 9/2004 | Lohbeck | E21B 43/105 166/384 |
| 2004/0216891 | A1 | 11/2004 | Maguire | |
| 2005/0056433 | A1* | 3/2005 | Ring | E21B 43/105 166/384 |

(Continued)

OTHER PUBLICATIONS

International Search Report and Written Opinion issued in related PCT Application No. PCT/US2019/029052 dated Sep. 25, 2019, 11 pages.

(Continued)

*Primary Examiner* — Taras P Bemko
(74) *Attorney, Agent, or Firm* — Baker Botts L.L.P.

(57) ABSTRACT

The present disclosure relates generally to downhole tubulars, and more particularly, to tubular expanders for downhole tubulars that have a detachable expansion ring, which can be detached from the tubular expander in the event that full expansion cannot be achieved or the tubular expander should get stuck in the downhole tubular being expanded. The detachable expansion ring may be attached to an end of an expansion cone that is disposed within a main body of the tubular expander. Tubing hangers are one exemplary downhole tubular device which can be expanded using the tubular expander in accordance with the present invention.

20 Claims, 5 Drawing Sheets

(56) References Cited

U.S. PATENT DOCUMENTS

| | | | | |
|---|---|---|---|---|
| 2006/0254779 | A1* | 11/2006 | Lynde | E21B 29/10 166/380 |
| 2007/0056743 | A1* | 3/2007 | Costa | E21B 43/103 166/380 |
| 2007/0221374 | A1* | 9/2007 | Filippov | E21B 43/103 166/207 |
| 2009/0014172 | A1* | 1/2009 | Costa | E21B 7/20 166/207 |
| 2010/0089591 | A1 | 4/2010 | Thomson et al. | |
| 2012/0222868 | A1 | 9/2012 | Hazelip | |
| 2015/0292305 | A1* | 10/2015 | Galloway | E21B 33/128 166/380 |

OTHER PUBLICATIONS

International Preliminary Report on Patentability issued in related PCT Application No. PCT/US2019/029052 dated Nov. 5, 2020, 7 pages.

* cited by examiner

TUBULAR EXPANDER WITH DETACHABLE EXPANSION RING

CROSS-REFERENCE TO RELATED APPLICATION

The present application is a U.S. National Stage Application of International Application No. PCT/US2019/029052 filed Apr. 25, 2019, which claims priority to U.S. Provisional Application Ser. No. 62/663,564 filed on Apr. 27, 2018, both of which are incorporated herein by reference in their entirety for all purposes.

TECHNICAL FIELD

The present disclosure relates generally to downhole tubulars, and more particularly, to tubular expanders having a detachable expansion ring that can be easily drilled out of the inside of a tubular member.

BACKGROUND

The drilling, completion and servicing of oil and gas wells typically requires the use of strings of tubulars of various sizes in a wellbore in order to transport tools, provide a path for drilling and production fluids, and in some cases, to line the wellbore in order to isolate hydrocarbon bearing formations and provide support to the wellbore. The first step of forming such wells typically involves drilling a borehole into a subterranean formation. If the subterranean formation lacks structural integrity, it is typically lined with casing, which is inserted into the well and then cemented in place. As the well is drilled to a greater depth, smaller diameter strings of casing are lowered into the wellbore and attached to the bottom of the previous string of casing. The deeper the formation, the narrower the tubular members that are employed given the telescoping nature of how the strings are connected to one another.

It is necessary that a sufficient amount of space must exist in the space formed between the nested tubulars in order to facilitate the fixing, hanging and/or sealing of one tubular from another or the passage of cement or other fluid through the annulus. The hanging of downhole tubulars in this fashion starts at the wellhead and continues down the entire length of the wellbore. As wellbores get deeper and deeper, especially in offshore environments, the nesting of tubulars in this manner results in a narrowed production pipe. The narrower the production pipe, the smaller the amount of production that is capable of being drawn out of the well over a given period of time. It has therefore been desirable to expand downhole tubulars, including casing and production pipe in order to increase the flow area of the hydrocarbons being produced.

The desire to expand downhole tubulars extends not only to the nested tubing itself, but also to the various liner hangers upon which the nesting tubing hangs from the wellhead as well as the intermediate junctions along the wellbore.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system-related and business-related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Although the present disclosure and its advantages have been described in detail, it should be understood that various changes, substitutions, and alterations can be made herein without departing from the spirit and scope of the disclosure as defined by the following claims.

Figure 1:
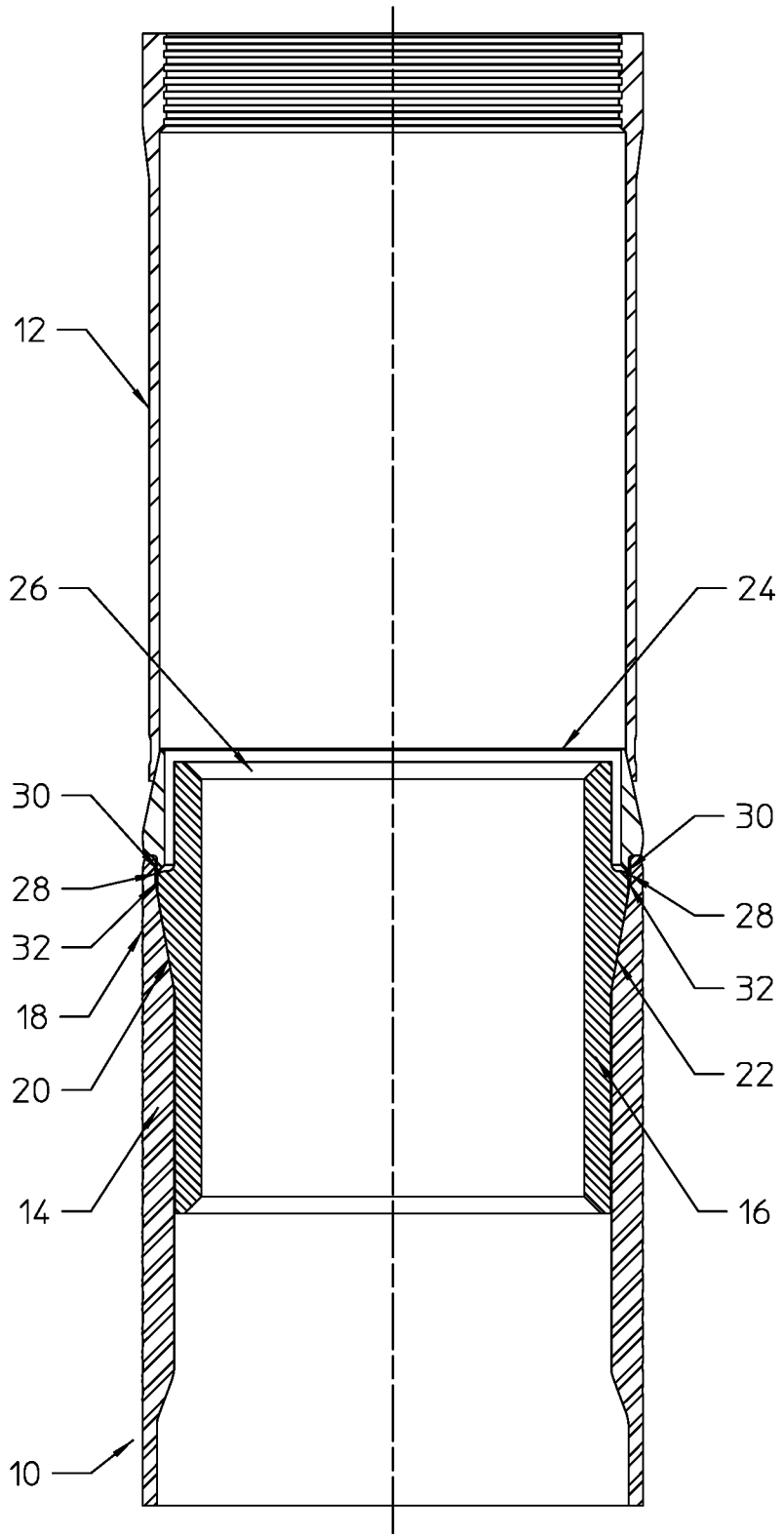
FIG. 1 is a longitudinal cross-sectional view of a tubular expander in accordance with one embodiment of the present invention shown adjacent to a liner hanger body prior to expansion of the liner hanger body by the tubular expander.

Turning now to FIG. 1, a tubular expander in accordance with the present invention is shown generally by reference numeral 10. As those of ordinary skill in the art will appreciate, the tubular expander 10 can be used to expand almost any tubular device. In one exemplary embodiment, it is used to expand the inner diameter of a liner hanger body 12. The liner hanger body 12 is generally cylindrical in shape and has an inner diameter, which is less than the outer diameter of the tubular expander 10. Liner hangers are generally used to hang strings of downhole tubulars. In a typical oil and gas well, there are a series of liner hangers disposed along the length of the wellbore. As previously noted, each series of tubing strings has a progressively narrower diameter pipe. Tubular expanders, such as tubular expander 10, are used to expand the pipe, such as liner hanger body 12, so that the tubulars have an increased inner diameter along the length of the well. In some embodiments, the goal is to create a mono-diameter pipe along the length of the wellbore. Such pipe can be casing or production pipe.

The tubular expander 10 may include a main tubular body 14 and an inner tubular expansion cone 16 disposed within the main tubular body 14. The main tubular body 14 may be formed of a generally cylindrical metal pipe. The inner tubular expansion cone 16 may be disposed within a distal end 18 of the main tubular body 14. The main tubular body 14 may have a tapered inner surface 20 adjacent to and engageable with a complementary outer tapered surface 22 of the inner tubular expansion cone 16. The tapered surfaces 20 and 22 may be generally frustoconical. The inner tubular expansion cone 16 may be formed of a generally cylindrical metal pipe. The inner tubular expansion cone 16 may be secured within the main tubular body 14 through various means. Without limitation, such means may include through any suitable fasteners, threading, adhesives, welding, or combinations thereof. In one exemplary embodiment, the inner tubular expansion cone 16 may be held in place along with the main tubular body 14 by a running tool. As those of ordinary skill in the art will appreciate, there may be a number of different suitable ways to secure the inner tubular expansion cone 16 to the main tubular body 14.

The tubular expander 10 may further include an expansion ring 24 longitudinally detachable from a distal end 26 of the inner tubular expansion cone 16. The expansion ring 24 may be generally cylindrical in shape. The expansion ring 24 may include an outer curvilinear surface, which has a diameter greater than the outer diameter of the main tubular body 14. In one exemplary embodiment, the diameter of the outer curvilinear surface of the expansion ring 24 may also be greater than the diameter of the inner cylindrical surface of the liner hanger body 12. In one exemplary embodiment, the expansion ring 24 is formed of an easily drillable material. Exemplary materials include, for example, aluminum, copper alloys, mild steel, or combinations thereof.

In one exemplary embodiment, the expansion ring 24 may be detachably connected to the inner tubular expansion cone 16 by an interference fit. In this embodiment, which is illustrated in FIG. 1, the expansion ring 24 may be disposed over a ring-shaped recess 28 formed at the distal end 26 of the inner tubular expansion cone 16 with an edge 30 of the expansion ring 24 abutting against a shoulder 32 of the inner tubular expansion cone 16, wherein the shoulder 32 is formed by said recess 28. As those of ordinary skill in the art will appreciate, other means of removably attaching the expansion ring 24 to the inner tubular expansion cone 16 may be used. One known example would be the use of one or more equally-spaced shear pins.

Figure 2:
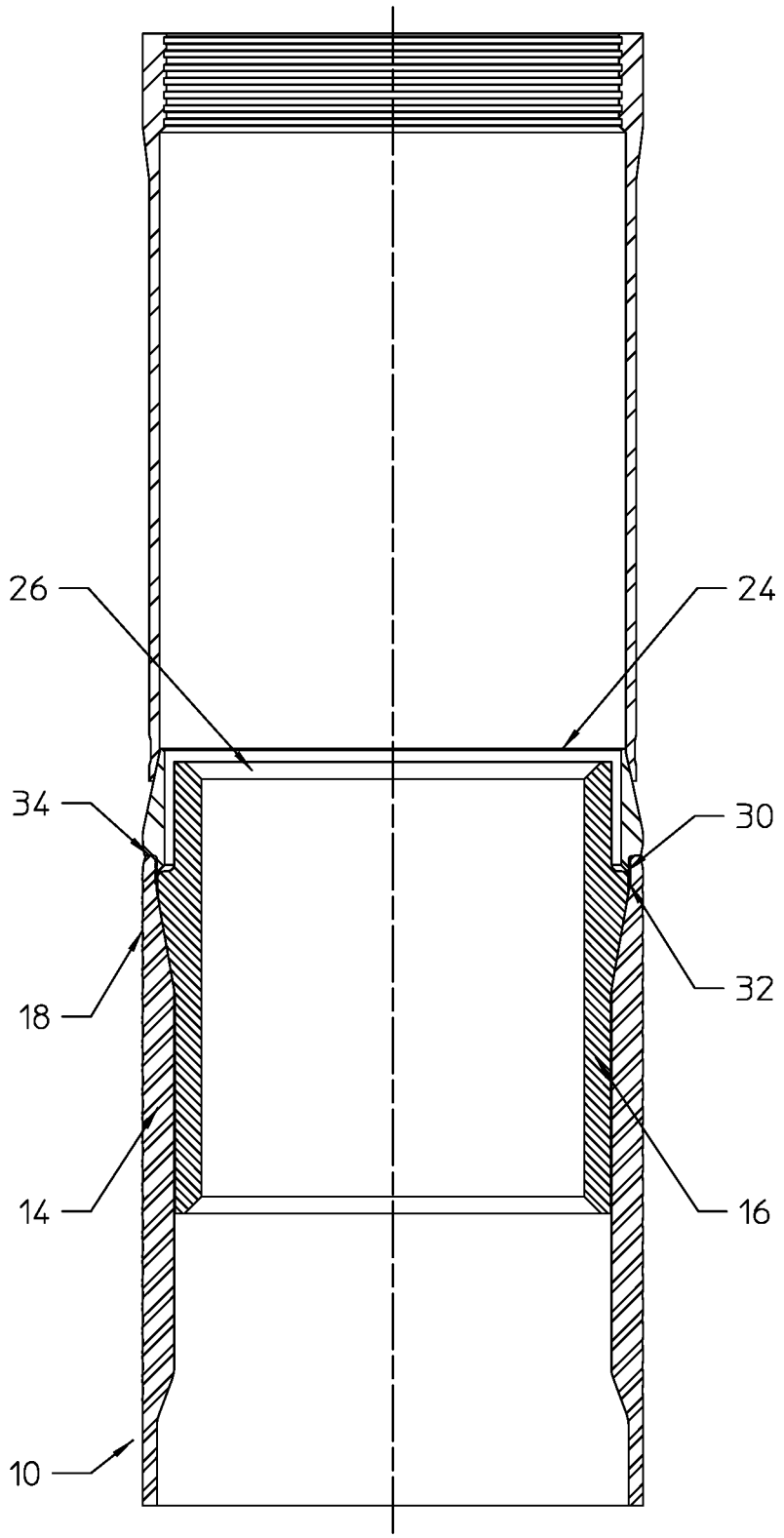
FIG. 2 is a longitudinal cross-sectional view of a tubular expander in accordance with one embodiment of the present disclosure shown adjacent to a liner hanger body prior to expansion of the liner hanger body by the tubular expander.

In another embodiment, the expansion ring 24 may be detachably threaded over the distal end 26 of the inner tubular expansion cone 16, as shown in FIG. 2. In this specific embodiment, at least a portion of the interior of the expansion ring 24 may be threaded and at least a portion of the exterior of the distal end 26 of the inner tubular expansion cone 16 may be threaded. The threads of both the expansion ring 24 and the distal end 26 may be threadably engaged to couple the expansion ring 24 to the inner tubular expansion cone 16. The expansion ring 24 may be threaded along the distal end 26 so far as to abut the edge 30 of the expansion ring 24 against the shoulder 32 of the inner tubular expansion cone 16. Further, the expansion ring 24 may comprise an outer lip 34 capable of receiving the distal end 18 of the main tubular body 14 of the tubular expander 10. Other examples of detachably coupling the expansion ring 24 to the inner tubular expansion cone 16 are within the knowledge and skill of those of ordinary skill in the art.

Figure 3:
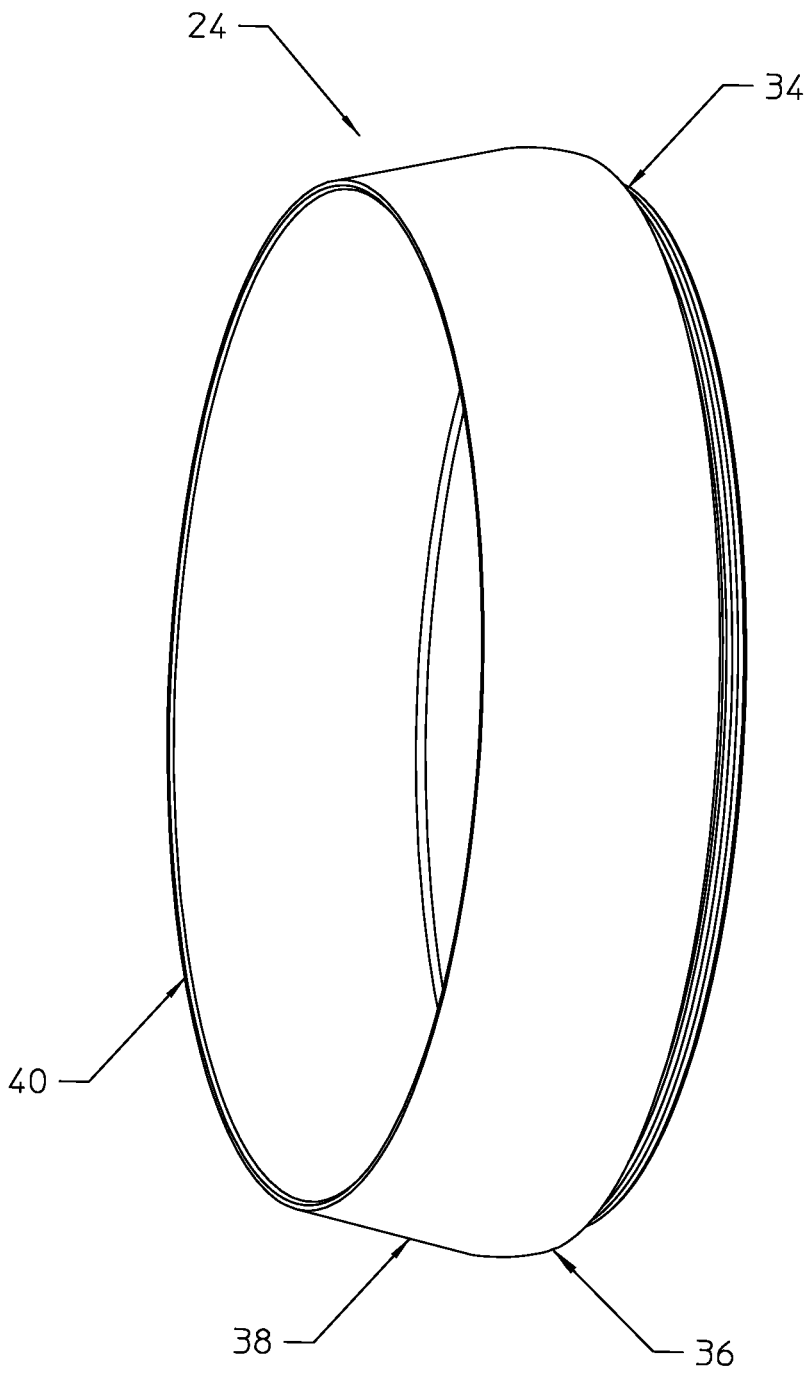
FIG. 3 is an elevational view of an expansion ring, which forms a part of the tubular expander shown in FIG. 1 in accordance with one embodiment of the present invention.

The expansion ring 24 is more fully seen in FIG. 3, which illustrates the outer curvilinear surface 36 of the expansion ring 24, which in one exemplary embodiment is partially hemispherical in shape. As those of ordinary skill in the art will appreciate, the outer surface 36 of the expansion ring 24 may take the form of a host of other suitable shapes. As shown, the outer lip 34 may be disposed below the outer curvilinear surface 36. As previously described, the outer curvilinear surface 36 may have a diameter greater than the outer diameter of the main tubular body 14 (referring to FIG. 1) and/or the inner diameter of the liner hanger body 12 (referring to FIG. 1). The outer curvilinear surface 36 may be disposed tangentially against an outer taper 38 of the expansion ring 24. In embodiments, the outer taper 38 may slope downwards towards the central axis of the expansion ring 24 as the length of the outer taper 38 increases from the outer curvilinear surface 36. A terminating end 40 of the outer taper 38 may be disposed opposite to the outer curvilinear surface 36 along the outer taper 38. In embodiments, the terminating end 40 may have a diameter less than that of the outer curvilinear surface 36, wherein the outer curvilinear surface 36 may be the base of the outer taper 38. The terminating end 40 may serve to enter into the interior of a suitable tubular.

The primary function of the expansion ring 24 may be to expand the inner diameter of the liner hanger body 12 (referring to FIG. 1) as the tubular expander 10 (referring to FIG. 1) is run through the liner hanger body 12, wherein the tubular expander 10 may include the inner tubular expansion cone 16 (referring to FIG. 1) detachable coupled to the expansion ring 24. As the tubular expander 10 abuts the liner hanger body 12, the terminating end 40 may slide into the interior of the liner hanger body 12 as the terminating end 40 may have a diameter less than the inner diameter of the liner hanger body 12. As the tubular expander 10 continues to travel downhole, the outer taper 38 may apply force against the interior of the liner hanger body 12. In some embodiments, the force applied may result in a plastic deformation of the liner hanger body 12, wherein the diameter of the liner hanger body 12 is increased.

Figure 4:
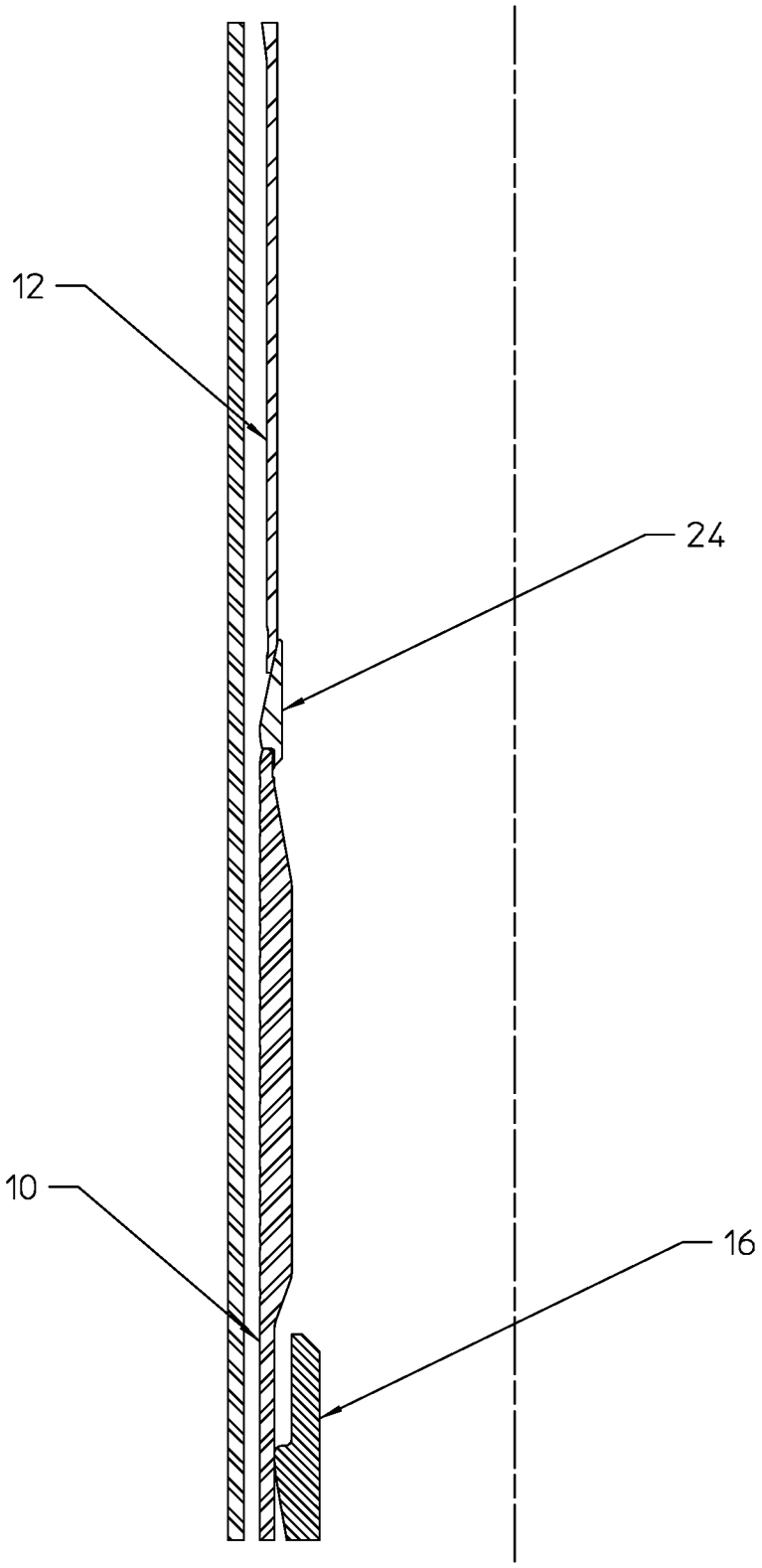
FIG. 4 is a longitudinal cross-sectional view of the tubular expander of FIG. 1 showing it being run through the inner surface of the liner hanger and partially expanding the same.
Figure 5:
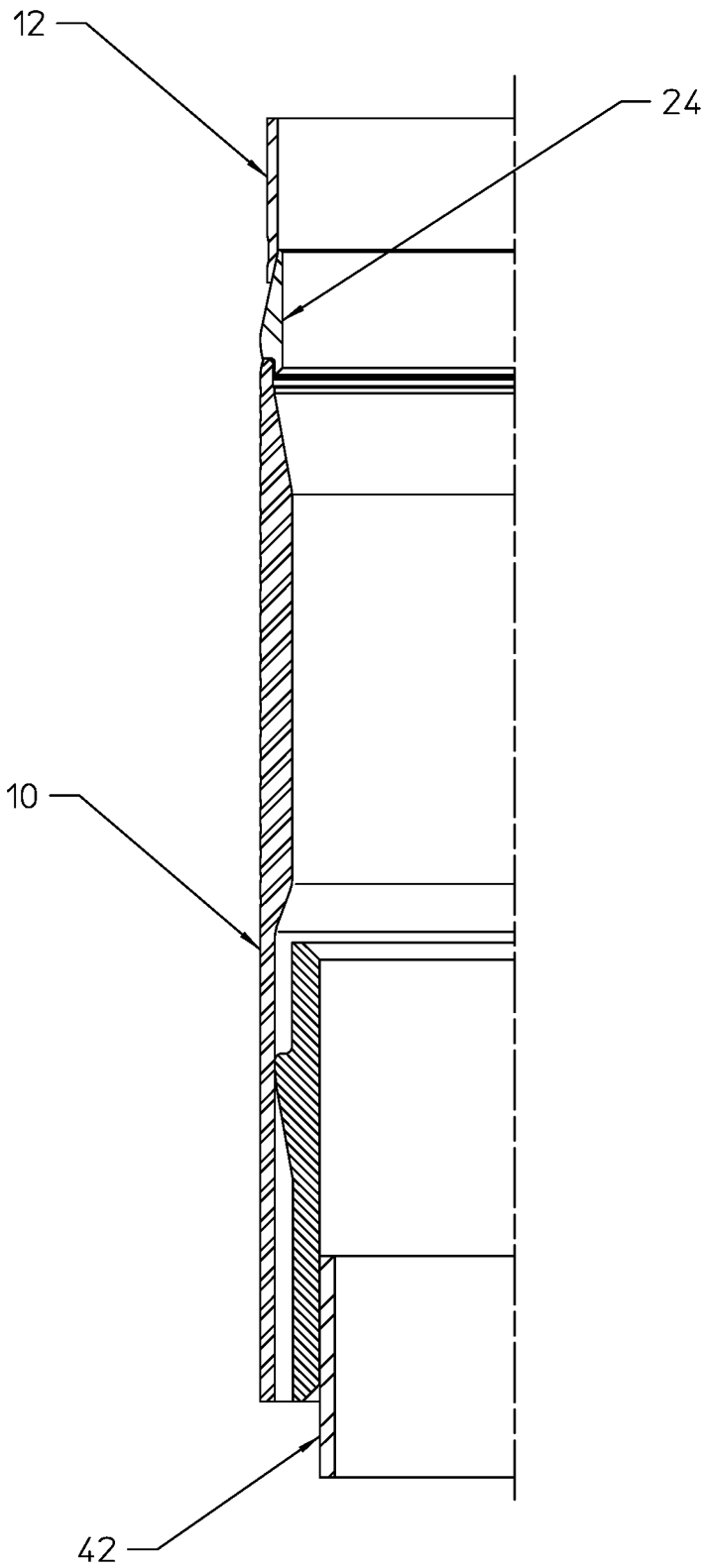
FIG. 5 is a partial cutaway view of the tubular expander of FIG. 1 with a secondary tool and a detached expansion ring.

FIG. 4 illustrates an embodiment wherein the expansion ring 24 has detached from the inner tubular expansion cone 16. As illustrated, the tubular expander 10 had expanded the liner hanger body 12 up to a certain length until the expansion ring 24 detached from the inner tubular expansion cone 16. In the event that it is determined that full expansion cannot be achieved, or the tubular expander 10 becomes unexpectedly stuck inside the inner surface of the liner hanger body 12, then the expansion can be continued by a secondary tool. This may be done in two stages; first by running the secondary tool 42 through the tubular expander 10 and then through the liner hanger body 12, as is shown in FIG. 5. If this should occur, the expansion ring 24 can be later drilled out of the liner hanger body 12 or can be left in place.

In another aspect of the present disclosure, a method of expanding a tubular member is provided. The method includes the step of deploying the tubular expander 10 into the inner surface of the tubular member, which may optionally be a liner hanger body, such as liner hanger body 12. The method further includes the step of running the tubular expander 10 along the inner surface of the tubular member such that the expansion ring 24 causes the diameter of the tubular member to expand as it runs along the inner surface of the tubular member, such as is shown in the expansion shown in FIG. 4 of the liner hanger body 12. The method may further include detaching the expansion ring 24 from the expansion cone 16 in the event that the tubular member fails or ceases to expand or the expansion ring 24 becomes stuck inside the inner surface of the tubular member. In one exemplary embodiment, the expansion ring 24 detaches from the expansion cone 16 when the frictional force between the outer surface of the expansion ring 24 and the inner surface of the tubular member is greater than that formed by the interference fit formed between the expansion ring 24 and the inner tubular expansion cone 16. As a pulling tool pulls the tubular expander 10 out of the tubular member, the expansion ring 24 may be left installed inside the tubular member. As noted above, the expansion ring 24 can later be drilled out of the tubular member. In the embodiment of FIGS. 2 and 4, the expansion ring 24 can be left in place.

What is claimed is:

1. A tubular expander, comprising:

a. a main tubular body;

b. an inner tubular expansion cone disposed within the main tubular body; and c. an expansion ring longitudinally detachable from a distal end of the inner tubular expansion cone, wherein the expansion ring is detachably connected to the inner tubular expansion cone by an interference fit of the expansion ring over the distal end of the inner tubular expansion cone.

2. The tubular expander as defined in claim 1, wherein the main tubular body has a tapered inner surface adjacent to and engageable with an outer surface of the inner tubular expansion cone.

3. The tubular expander as defined in claim 2, wherein the outer surface of the inner tubular expansion cone engageable with the tapered inner surface of the main tubular body has a complementary tapered surface.

4. The tubular expander as defined in claim 3, wherein the expansion ring comprises an outer curvilinear surface, which has an outer diameter greater than the outer diameter of the main tubular body.

5. The tubular expander as defined in claim 4, wherein the outer curvilinear surface of the expansion ring is partially hemispherical in shape.

6. The tubular expander as defined in claim 4, wherein the expansion ring comprises an outer taper disposed adjacent to the outer curvilinear surface, wherein the outer taper is angled towards the central axis of the expansion ring.

7. The tubular expander as defined in claim 6, wherein the expansion ring comprises a terminating end opposite to the outer curvilinear surface, wherein the outer diameter of the terminating end is less than the outer diameter of the outer curvilinear surface.

8. The tubular expander as defined in claim 1, wherein the expansion ring fits over a recess formed in the distal end of the inner tubular expansion cone with an edge of the expansion ring abutting against a shoulder formed by said recess.

9. The tubular expander as defined in claim 1, wherein the expansion ring is formed of a drillable material.

10. The tubular expander as defined in claim 1, wherein the main tubular body comprises a distal end having a nose formed thereon and the expansion ring has an outer lip, which engages with the nose of the main tubular body.

11. A method of expanding a tubular member, comprising:

a. deploying a tubular expander having a main tubular body, an inner tubular expansion cone disposed within the main tubular body, and an expansion ring longitudinally detachable from a distal end of the inner tubular expansion cone into an inner surface of the tubular member;

b. running the tubular expander along the inner surface of the tubular member such that the expansion ring causes the diameter of the tubular member to expand as it runs along the inner surface of the tubular member; and c. detaching the expansion ring from the inner tubular expansion cone, wherein the expansion ring detaches from the inner tubular expansion cone by overcoming a frictional force created by an interference fit formed between the expansion ring and the inner tubular expansion cone.

12. The method of expanding a tubular member as defined in claim 11, wherein the expansion ring detaches from the inner tubular expansion cone in the event that the tubular member fails or ceases to expand or the expansion ring becomes stuck inside the inner surface of the tubular member.

13. The method of expanding a tubular member as defined in claim 12, further comprising leaving the detached expansion ring installed within the inner surface of the tubular member.

14. The method of expanding a tubular member as defined in claim 12, further comprising drilling the expansion ring out of the inner surface of the tubular member.

15. The method of expanding a tubular member as defined in claim 12, further comprising disposing a secondary tool downhole to continue the expansion of the tubular member.

16. The method of expanding a tubular member as defined in claim 15, wherein disposing the secondary tool downhole comprises running the secondary tool through the tubular expander and the tubular member.

17. The method of expanding a tubular member as defined in claim 11, wherein the tubular member comprises a liner hanger having an inner surface having a diameter smaller than an outer diameter of the expansion ring, such that as the expansion tubular is run through the liner hanger its diameter is expanded by the expansion ring.

18. A tubular expander, comprising:

a. a main tubular body;

b. an inner tubular expansion cone disposed within the main tubular body; and c. an expansion ring longitudinally detachable from a distal end of the inner tubular expansion cone, wherein the expansion ring is detachably connected to the inner tubular expansion cone via a threaded connection.

19. The tubular expander as defined in claim 18, wherein the main tubular body comprises a distal end having a nose formed thereon and the expansion ring has an outer lip, which engages with the nose of the main tubular body.

20. The tubular expander as defined in claim 18, wherein the expansion ring is formed of a drillable material.

* * * * *